US012588712B2

(12) United States Patent
Fallon et al.

(10) Patent No.: US 12,588,712 B2
(45) Date of Patent: Mar. 31, 2026

(54) AEROSOL PROVISION SYSTEM

(71) Applicant: Nicoventures Trading Limited, London (GB)

(72) Inventors: Gary Fallon, London (GB); Walid Abi Aoun, London (GB)

(73) Assignee: NICOVENTURES TRADING LIMITED, London (GB)

( * ) Notice: Subject to any disclaimer, the term of this patent is extended or adjusted under 35 U.S.C. 154(b) by 648 days.

(21) Appl. No.: 17/756,494

(22) PCT Filed: Nov. 27, 2020

(86) PCT No.: PCT/GB2020/053042

§ 371 (c)(1),
(2) Date: May 26, 2022

(87) PCT Pub. No.: WO2021/105705

PCT Pub. Date: Jun. 3, 2021

(65) Prior Publication Data

US 2023/0000170 A1 Jan. 5, 2023

(30) Foreign Application Priority Data

Nov. 29, 2019 (GB) ..... 1917446

(51) Int. Cl.

| | |
|---|---|
| ***A24F 40/57*** | (2020.01) |
| ***A24F 40/465*** | (2020.01) |
| ***A24F 40/51*** | (2020.01) |
| ***A24F 40/60*** | (2020.01) |

(52) U.S. Cl.
CPC ..... *A24F 40/57* (2020.01); *A24F 40/465* (2020.01); *A24F 40/51* (2020.01); *A24F 40/60* (2020.01)

(58) Field of Classification Search
None
See application file for complete search history.

(56) References Cited

U.S. PATENT DOCUMENTS

| | | | | |
|---|---|---|---|---|
| 2006/0047368 | A1 | 3/2006 | Maharajh et al. | |
| 2018/0043114 | A1* | 2/2018 | Bowen | A61M 15/06 |
| 2019/0289915 | A1 | 9/2019 | Heidl et al. | |

FOREIGN PATENT DOCUMENTS

| | | | |
|---|---|---|---|
| CN | 104114049 | A | 10/2014 |
| JP | 2019521739 | A | 8/2019 |
| RU | 2647805 | C2 | 3/2018 |
| WO | WO-2017205692 | A1 | 11/2017 |

OTHER PUBLICATIONS

Office Action and Search Report issued in corresponding Russian Patent Application No. 2022117358 mailed May 31, 2024, all pages cited in its entirety.

(Continued)

*Primary Examiner* — Cynthia Szewczyk
(74) *Attorney, Agent, or Firm* — BURR & FORMAN

(57) ABSTRACT

There is provided an aerosol provision system comprising a power source; an aerosol generating component; and, control circuitry, wherein the control circuitry is arranged to control the power source and the aerosol generating component to provide a selection between at least: a predetermined aerosolization profile; and a variable aerosolization period, to be applied to aerosol generating material.

13 Claims, 4 Drawing Sheets

(56) References Cited

OTHER PUBLICATIONS

International Search Report and Written Opinion for Application No. PCT/GB2020/053042, mailed on Mar. 12, 2021, 8 pages.
Office Action (with English Translation) issued in corresponding Korean Patent Application No. 10-2022-7016932 mailed Nov. 1, 2024, all pages cited in its entirety.
Substantive Examination report from corresponding MX Application No. MX/a/2022/006483, mailed May 9, 2025, all pages cited in its entirety.

* cited by examiner

AEROSOL PROVISION SYSTEM

PRIORITY CLAIM

The present application is a National Phase entry of PCT Application No. PCT/GB2020/053042, filed Nov. 27, 2020, which claims priority from Great Britain Application No. 1917446.5, filed Nov. 29, 2019, each of which is hereby fully incorporated herein by reference.

TECHNICAL FIELD

The present disclosure relates to an aerosol provision system, a method of producing an aerosol from an aerosol provision system and aerosol provision means.

BACKGROUND

Aerosol provision systems are known. Aerosol provision systems often have aerosol generating components for generating aerosols from aerosol generating material. Modern devices operate on demand as a result of a user pushing a button or inhaling on the device prior to a puff being delivered to the user. Such devices deliver energy from a power source to an aerosol generating component. This set process can be repeated to provide more aerosol to a user.

It is desirable to provide a user with flexibility over the aerosol produced by an aerosol provision system to improve the user experience of the aerosol provision system.

The present disclosure is directed toward solving some of the above problems.

SUMMARY

Aspects of the disclosure are defined in the accompanying claims.

In accordance with some embodiments described herein, there is provided an aerosol provision system comprising: a power source; an aerosol generating component; and, control circuitry, wherein the control circuitry is arranged to control the power source and the aerosol generating component to provide a selection between at least: a predetermined aerosolization profile; and a variable aerosolization period, to be applied to aerosol generating material.

In accordance with some embodiments described herein, there is provided a method of producing an aerosol from an aerosol provision system, the method comprising: providing a power source; providing an aerosol generating component; and, providing control circuitry, the control circuitry arranged to control the power source and the aerosol generating component, providing a selection between at least: a predetermined aerosolization profile; and a variable aerosolization period, to be applied to aerosol generating material, applying the selected one of the predetermined aerosolization profile and the variable aerosolization period to aerosol generating material.

In accordance with some embodiments described herein, there is provided aerosol provision means comprising: power means; aerosol generating means; and, control circuitry, wherein the control circuitry is arranged to control the power means and the aerosol generating means to provide a selection between at least: a predetermined aerosolization profile; and a variable aerosolization period, to be applied to aerosol generating material.

BRIEF DESCRIPTION OF THE DRAWINGS

The present teachings will now be described by way of example only with reference to the following figure.

Figure 1:
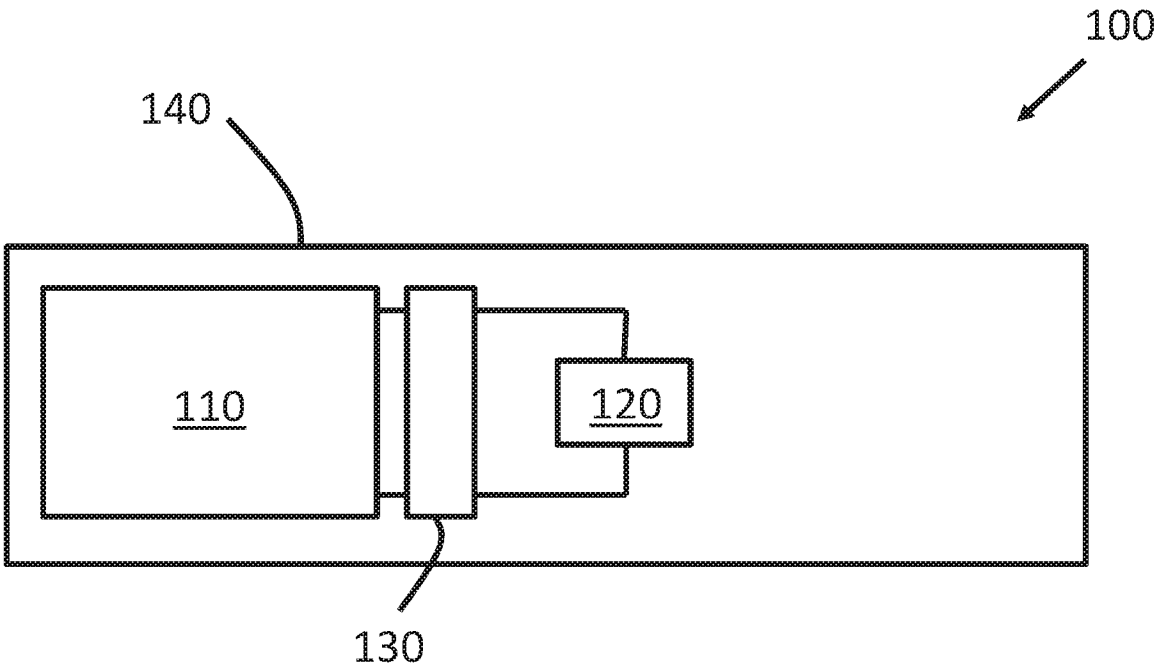
FIG. 1 is a longitudinal cross-sectional view of an aerosol provision system according to an example.

While the disclosure is susceptible to various modifications and alternative forms, specific embodiments are shown by way of example in the drawings and are herein described in detail. It should be understood, however, that the drawings and detailed description of the specific embodiments are not intended to limit the disclosure to the particular forms disclosed. On the contrary, the disclosure covers all modifications, equivalents and alternatives falling within the scope of the present disclosure.

DETAILED DESCRIPTION OF THE DRAWINGS

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Throughout the following description the term "e-cigarette" or "electronic cigarette" may sometimes be used, but it will be appreciated this term may be used interchangeably with aerosol provision system/device and electronic aerosol provision system/device. Furthermore, and as is common in the technical field, the terms "aerosol" and "vapor", and related terms such as "vaporize", "volatilize" and "aerosolize", may generally be used interchangeably.

In the example of FIG. 1, an aerosol provision system 100 is shown. The aerosol provision system 100 has a power source 110. The aerosol provision system 100 has an aerosol generating component 120. The aerosol provision system 100 has control circuitry 130. The control circuitry 130 is arranged to control the power source 110 and the aerosol generating component 120 to provide a selection between at least a predetermined aerosolization profile and a variable aerosolization period to be applied to aerosol generating material.

The power source 110 is shown connected to the aerosol generating component 120. The connection may be an electrical connection to allow the power source 110 to provide electrical signals to the aerosol generating component 120. The power source 110 may provide energy to the aerosol generating component 120 for aerosolization of aerosol generating material.

The power source 110 is shown connected to the control circuitry 130. The control circuitry 130 may control the delivery of energy from the power source 110 to the aerosol generating component 120. The control circuitry 130 may operate to control delivery of energy from the power source 110 to aerosol generating component 120 to provide a predetermined amount of aerosolization from aerosol generating material.

The power source 110 may, in an example, be a battery or the like. The power source 110 may contain chemical energy which can be converted and delivered as electrical energy.

In example shown in FIG. 1, the aerosol provision system 100 has a housing 140 within which the power source 110, the aerosol generating component 120 and the control circuitry 130 are located.

The predetermined aerosolization profile may comprise a plurality of aerosolization phases and a plurality of non-aerosolization phases. The aerosolization phases may be phases wherein the aerosol generating component 120 is supplied with energy from the power source 110, under control of the control circuitry 130. The non-aerosolization phases may be phases wherein the aerosol generating component 120 is not supplied with energy from the power source 110. The predetermined aerosolization profile may be a profile that can be selected by a user desiring the delivery of aerosol over an extended "smoking session". The predetermined aerosolization profile may therefore have a sequence of active periods and non-active periods, the timings of which may be predetermined and which may be different (or the same) for each period. This may produce aerosol for inhalation at specific timings over a given period.

The variable aerosolization period may be a continuous period, which can be varied in length, wherein the aerosol generating component 120 is supplied with energy from the power source 110, under control of the control circuitry 130. The variable aerosolization period may be user controlled so that the user can select a relatively long, or short, period over which to produce an aerosol. The variable aerosolization period therefore does not have non-aerosolization phases alongside aerosolization phases. The variable aerosolization period is rather an on or off use-mode for the system 100. In an example, there is a cap on the maximum length of the variable aerosolization period so as to prevent misuse of this setting. For example, the longest single use may be capped at less than 30 s or the like. This can function as a safety feature so as to protect the system 100.

Figure 2:
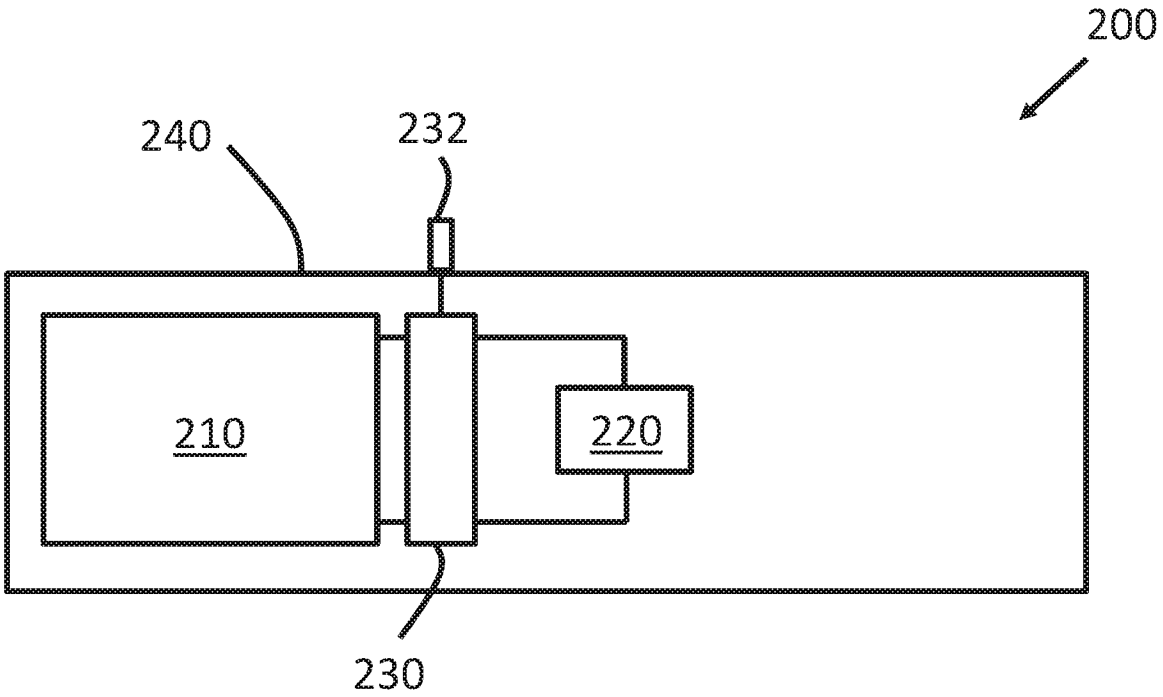
FIG. 2 is a longitudinal cross-sectional view of an aerosol provision system according to an example.

In the example of FIG. 2, an aerosol provision system 200 is shown. The aerosol provision system 200 has similar features to the example of an aerosol provision system 100 shown in FIG. 1. Similar features have similar numerals with the number increased by 100. These will not necessarily be discussed in detail here.

The aerosol provision system 200 shown in the example of FIG. 2 has control circuitry 230 which has an activatable element 232. The activatable element 232 is for controlling the power source 210 and aerosol generating material 220. The activatable element 232 may be a user-activatable element (such as a button or switch or the like), a user interface (such as a touch sensitive screen, graphics user interface or the like) and/or a sensor (such as a fingerprint scanner, puff detector, QR code reader, barcode reader or the like). The activatable element 232 may be activated once a state detection is made. The state detection might be, for example, that an RFID sensor has detected an RFID known to be valid (by, for example, cross-reference with a database of valid RFIDs) such that the aerosol provision system 200 is controlled to provide energy from the power source 210 to the aerosol generating component 220. The activatable element may therefore be user activatable or non-user activatable.

A puff detector may allow for puff activation of the system 200. The puff detector may detect when the user is inhaling on the system 200 and therefore result in activation of the system 200. The system 200 may be activated to provide a predetermined aerosolization profile or a variable aerosolization period based on e.g., the length of time of inhalation or intensity of inhalation. For example, a short (less than 2 seconds) inhalation results in the system 200 providing an aerosolization period and a long (more than 2 seconds) inhalation results in the system 200 providing a predetermined aerosolization profile. The skilled person would be aware of implementations that could utilize puff activation.

The control circuitry 230 may be configured to determine a state of the activatable element 232 and based on the state of the activatable element 232, determine whether to apply the predetermined aerosolization profile or the variable aerosolization period to aerosol generating material. This may be that, for example, a fingerprint scanner has detected a movement in a first direction which results in the selection, and application of, a predetermined aerosolization profile. Alternatively, a fingerprint scanner may detect a movement in a second direction which results in the selection, and application of, a variable aerosolization period.

Figure 3A:
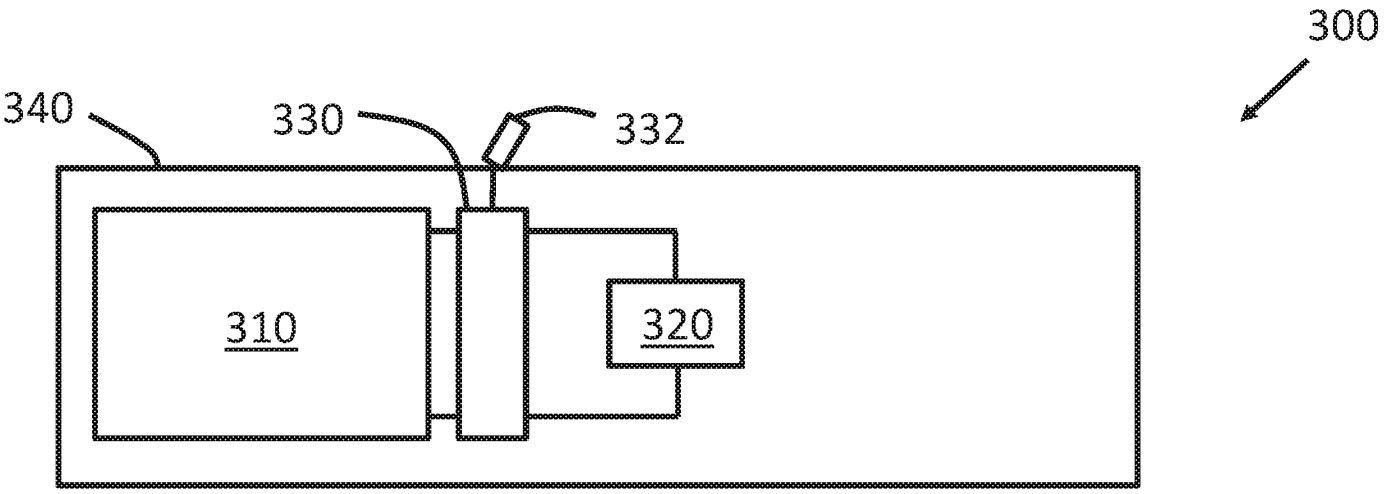
FIG. 3A is a longitudinal cross-sectional view of an aerosol provision system according to an example.
Figure 3B:
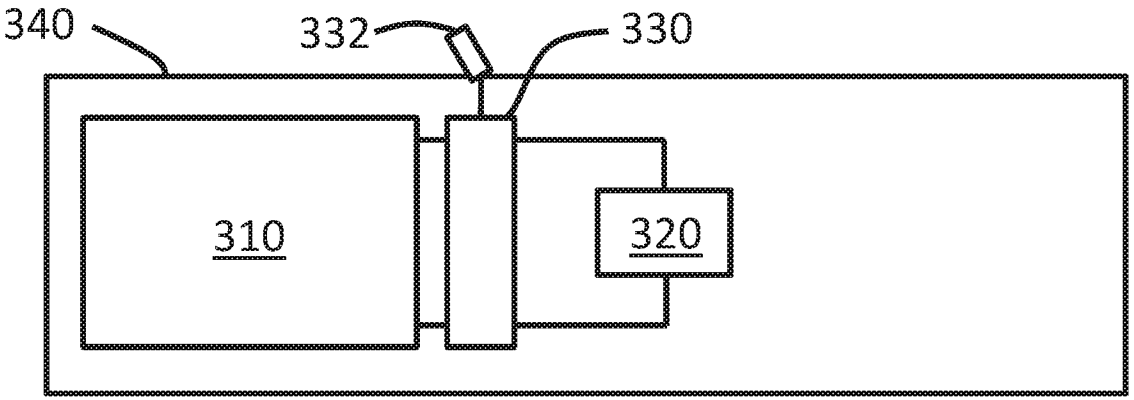
FIG. 3B is a longitudinal cross-sectional view of an aerosol provision system according to an example; and, FIG. 4 is a schematic flowchart for a method of producing an aerosol according to an example.

In the examples of FIGS. 3A and 3B, an aerosol provision system 300 is shown. The aerosol provision system 300 has similar features to the example of an aerosol provision system 200 shown in FIG. 2. Similar features have similar numerals with the number increased by 100. These will not necessarily be discussed in detail here.

FIG. 3A shows an aerosol provision system 300 with control circuitry 330 with an activatable element 332. The activatable element 332 is shown in a first state. The activatable element 332 is shown as a physical component, such as a button or switch or the like, however it may as easily be any of the above discussed options. The activatable element 332 merely needs to indicate a difference between states in which it may put, such as can be performed by a touchscreen. The activatable element 332 is put into a first state and signals to the control circuitry 330 that it is in the first state. The control circuitry 330 then controls the power source 310 to provide energy to the aerosol generating component 320 in a first manner. FIG. 3B shows an example of an aerosol provision system 300 wherein the activatable element 332 is in a second state, which may lead to the control circuitry to control the power source 310 to provide energy to the aerosol generating component 320 in a second manner. The activatable element 332 is shown on the housing 340 of the aerosol provision system 300 however may be located inside the aerosol provision system 300.

In an example, therefore, the activatable element 322 may be a user-activatable element, and the user-activatable element may be a switch that can be affected in a first way to provide a predetermined aerosolization profile to an aerosol generating material, and the switch can be affected in a second way to provide a variable aerosolization period to an aerosol generating material. In the example of FIG. 3, the switch 332 is moved towards one end of the system housing 340 for the first way and towards the other end of the system housing 340 for the second way. Another example may be a push button which is depressed slightly for a first way and depressed more/entirely for a second way.

The control circuitry 330 may have a database or the like for storing predetermined aerosolization profiles. The control circuitry 330 may therefore provide a selection between a plurality of predetermined aerosolization profiles and a variable aerosolization period to be applied to an aerosol generating material. This may allow the aerosol provision system 300 to accommodate users' preferences in aerosol. A first predetermined aerosolization profile may provide an aerosol with more or less nicotine (for example) than a second predetermined aerosolization profile. The user may select their preferred option of predetermined aerosolization profile. The user may make their selection from the activatable element 332, such as a graphic user interface on a touchscreen on the aerosol provision system 300.

In another example, the predetermined aerosolisation profile supplied by the control circuitry may be based on consumable recognition. A consumable containing a specific aerosol generating material (or combination of aerosol generating materials) may be inserted into the aerosol provision system 300 prior to use. The consumable may have a detectable element on it, such as a barcode, QR code or the like. The detectable element may be detected by the control circuitry 330 (or activatable element 332). This may allow the control circuitry 330 to provide a predetermined aerosolization profile to the consumable based on the specific aerosol generating material or aerosol generating materials present in the consumable, as detected and recognized by the control circuitry 330. In this way a suitable predetermined aerosolization profile may be provided to any specific consumable across a range of consumables. This, in turn, provides greater flexibility of use for a user of the aerosol provision system 300.

The predetermined aerosolization profiles that may be provided by the control circuitry 330 may differ to one another by any suitable factor. These include the number of aerosolization phases, the intensity of aerosolization phases and, the frequency of aerosolization phases. In an example, a predetermined aerosolization profile for use with a consumable which has a majority aerosol generating material of menthol may have a lower intensity of aerosolization phase (e.g., a lower operational temperature to produce an aerosol from the aerosol generating material) than a consumable which has a majority aerosol generating material of tobacco. This may be based on the operational temperatures at which a menthol consumable and a tobacco consumable generate aerosols.

The consumable may have a plurality of different sections each of which contains one or more aerosol generating materials. A first section may be provided with a first predetermined aerosolization profile, whereas a second section may be provided with a second predetermined aerosolization profile. The second predetermined aerosolization profile may differ from the first predetermined aerosolization profile.

In a specific example, the consumable has three sections. The first section may be heated to a low operational temperature (to release, for example, menthol). The second section may be heated to a high operational temperature (to release, for example, nicotine). The third section may be heated to a medium operational temperature (to release, for example, humectant say propylene glycol). A user may select which section to use and in which order to personalize the aerosol produced or their taste preference.

The consumable may provide around 10 puffs for a user. Therefore the frequency of variation of the profile may be with each puff which may be around every 30 seconds or so, as desired by the user.

The aerosol provision system 300 may provide a continuous aerosolization to any consumable provided to the aerosol provision system 300 as a result of interaction with the activatable element 332 in a predetermined manner. In an example, the activatable element 332 is a button which can be fully depressed to result in a continuous aerosolization being applied to aerosol generating material. In an example, the activatable element 332 is biased against being depressed. In this example, the user may depress the button for as long as is desired to produce an aerosol and then release to cease provision of energy from the power source 310 to the aerosol generating component 320. In an example, the aerosol provision system 300 is configured to be activated by the activatable element 332 such that the aerosol provision system 300 produces an aerosol within about 2 to 3 seconds of activation.

The aerosol generating component 320 may be a heating element. The aerosol generating component 320 may be a heating mechanism or part of a heating mechanism. In an example, the aerosol generating component 320 may be a heater for providing heat to aerosol generating material. The aerosol generating component 320 may be a resistive heater to provide heat to aerosol generating material from a current passed through it by an electrically connected power source 310. The aerosol generating component 320 may be made of metal or ceramic or the like.

In an example, the predetermined aerosolization profile may be a predetermined heating profile and the variable aerosolization period may be a heating period. In this example, activation of the activatable element 332 may result in the control circuitry 330 controlling delivery of energy from the power source 310 to the heater 320 to create heating via electrical resistance in the heater 320.

Alternatively or additionally, the aerosol generating component 320 may be an induction heater or a part of an inductive heating system for providing heat to the consumable. In this example, the heating mechanism may be part of an inductive heater which provides for rapid heating of aerosol generating material.

The heater may have an operational temperature of around from about 160 to about 300° C. for aerosolization of the aerosol generating material. Operational temperature is used herein to mean the temperature at which aerosol may be produced from the aerosol generating material. This may vary based on the aerosol generating material from which an aerosol is to be produced.

Figure 4:
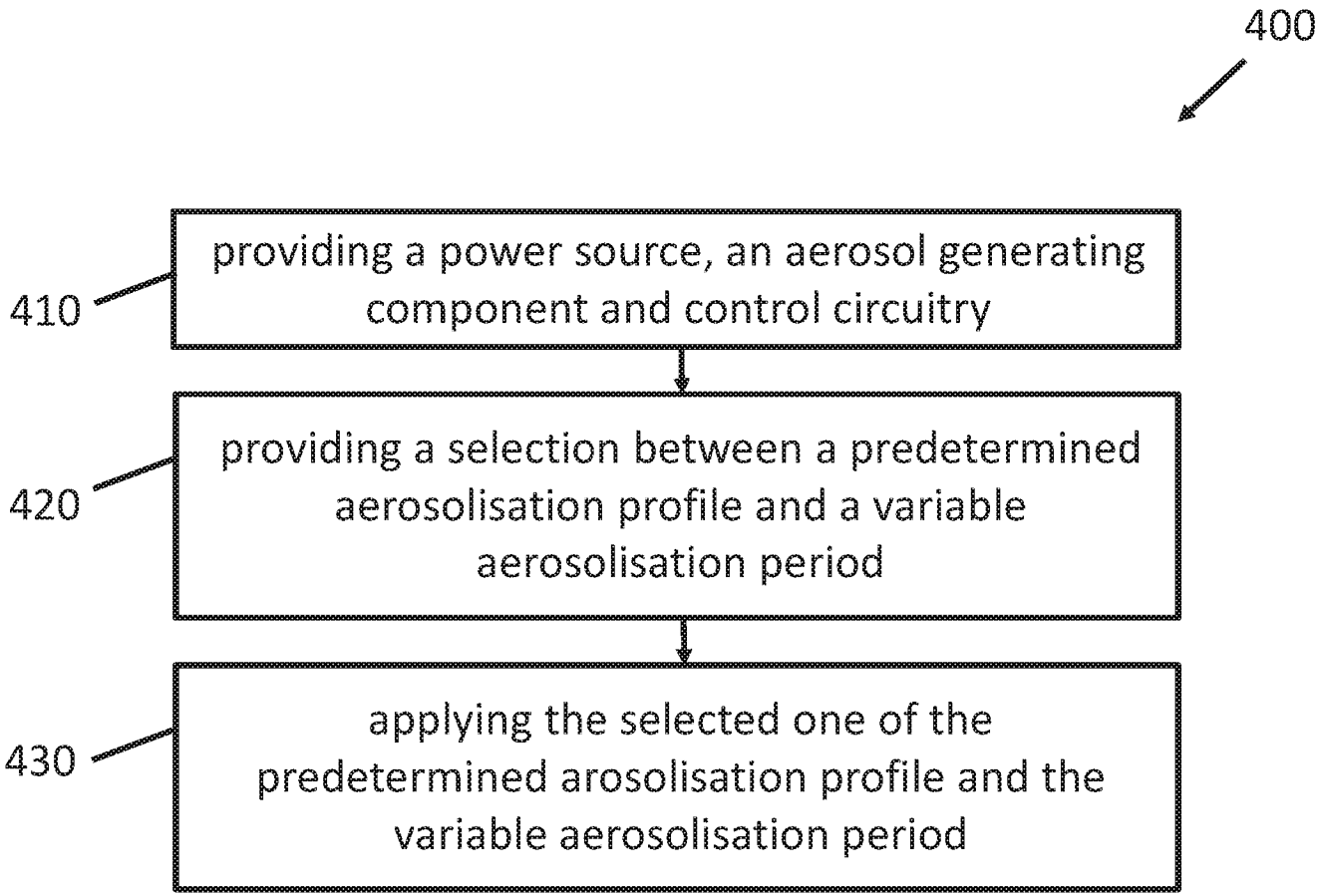

In FIG. 4 a schematic flowchart for a method of producing an aerosol is shown. The method 400 is shown with three steps 410, 420, 430. The first step 410 involves providing a power source, an aerosol generating component and control circuitry. The aerosol generating component may be in the form of a heater. Energy may be provided to the aerosol generating component by the power source (or an energy store or the like). The power source may be a battery or the like. The energy provided to the aerosol generating component may be controlled by the control circuitry. The control circuitry arranged to control the power source and the aerosol generating component. The energy provided to the aerosol generating component may be sufficient for the aerosol generating component to reach an operational condition, such as an operational temperature, to produce an aerosol from an aerosol generating medium.

The second step 420 involves providing a selection between a predetermined aerosolization profile and a variable aerosolization period. This selection is to be applied to aerosol generating material for production of aerosol. The third step 430 involves applying the selected one of a predetermined aerosolization profile and a variable aerosolization period to an aerosol generating material. As described above, this selection may occur as a result of activating, or altering the state of, an activatable element.

The aerosol provision system disclosed herein may be provided with aerosol generating material inside the housing or aerosol generating material may be removably insertable into the housing. The aerosol generating material may be in the form of a consumable which has a carrier support and an aerosol generating material. The consumable may comprise a number of different aerosol generating materials.

The aerosol generating component and aerosol generating medium may be arranged to be adjacent one another prior to use or within thermal contact. The aerosol generating component and aerosol generating medium may be arranged in a heater-and-wick combination. The aerosol generating medium may therefore be a liquid which is delivered to the wick and then aerosolized by energy from the aerosol generating component. The aerosol generating medium may be contained in a liquid reservoir or the like. The aerosol generating component may be part of a cartomizer or the like.

In some embodiments, the non-combustible aerosol provision system is an electronic cigarette, also known as a vaping device or electronic nicotine delivery system (END), although it is noted that the presence of nicotine in the aerosolizable material is not a requirement.

In some embodiments, the non-combustible aerosol provision system is a tobacco heating system, also known as a heat-not-burn system.

In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system.

In some embodiments, the non-combustible aerosol provision device may comprise a power source and a controller. The power source may, for example, be an electric power source.

In some embodiments, the article for use with the non-combustible aerosol provision device may comprise an aerosolizable material, an aerosol generating component, an aerosol generating area, a mouthpiece, and/or an area for receiving aerosolizable material.

In some embodiments, the aerosol generating component is a heater capable of interacting with the aerosolizable material so as to release one or more volatiles from the aerosolizable material to form an aerosol.

In some embodiments, the substance to be delivered may be an aerosolizable material. Aerosolizable material, which also may be referred to herein as aerosol generating material, is material that is capable of generating aerosol, for example when heated, irradiated or energized in any other way. Aerosolizable material may, for example, be in the form of a solid, liquid or gel which may or may not contain nicotine and/or flavorants. In some embodiments, the aerosolizable material may comprise an "amorphous solid", which may alternatively be referred to as a "monolithic solid" (i.e., non-fibrous). In some embodiments, the amorphous solid may be a dried gel. The amorphous solid is a solid material that may retain some fluid, such as liquid, within it. In some embodiments, the aerosolizable material may for example comprise from about 50 wt %, 60 wt % or 70 wt % of amorphous solid, to about 90 wt %, 95 wt % or 100 wt % of amorphous solid.

In some embodiments, the amorphous solid is formed from a gelling agent. In some embodiments, the amorphous solid comprises a gelling agent. The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In some embodiments, the non-cellulose based gelling agent is alginate or agar.

The aerosolizable material may comprise one or more active constituents, one or more carrier constituents and optionally one or more other functional constituents. The amorphous solid may comprise one or more active constituents, one or more carrier constituents and optionally one or more other functional constituents.

The active constituent may comprise one or more physiologically and/or olfactory active constituents which are included in the aerosolizable material in order to achieve a physiological and/or olfactory response in the user. The active constituent may for example be selected from nutraceuticals, nootropics, and psychoactives. The active constituent may be naturally occurring or synthetically obtained. The active constituent may comprise for example nicotine, caffeine, taurine, or any other suitable constituent. The active constituent may comprise a constituent, derivative or extract of tobacco or of another botanical. In some embodiments, the active constituent is a physiologically active constituent and may be selected from nicotine, nicotine salts (e.g. nicotine ditartrate/nicotine bitartrate), nicotine-free tobacco substitutes, other alkaloids such as caffeine.

In some embodiments, the aerosolizable material and/or amorphous solid comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The aerosolizable material and/or amorphous solid may comprise one or more cannabinoid compounds selected from the group consisting of cannabidiol (CBD) and THC (tetrahydrocannabinol).

The aerosolizable material and/or amorphous solid may comprise cannabidiol (CBD).

The aerosolizable material and/or amorphous solid may comprise nicotine and cannabidiol (CBD).

The aerosolizable material and/or amorphous solid may comprise nicotine, cannabidiol (CBD), and THC (tetrahydrocannabinol).

In some embodiments, the active constituent is an olfactory active constituent and may be selected from a "flavor" and/or "flavorant" which, where local regulations permit, may be used to create a desired taste, aroma or other somatosensorial sensation in a product for adult consumers. In some instances, such constituents may be referred to as flavors, flavorants, cooling agents, heating agents, or sweetening agents. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus Mentha, *eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the carrier constituent comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

he one or more other functional constituents may comprise one or more of pH regulators, coloring agents, preservatives, binders, fillers, stabilizers, and/or antioxidants.

The aerosolizable material and/or amorphous solid may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulfuric acid, hydrochloric acid, boric acid and phosphoric acid. In some embodiments, the acid is levulinic acid.

An acid may be included in embodiments in which the aerosolizable material comprises nicotine. In such embodiments, the presence of an acid may stabilize dissolved species in the slurry from which the aerosol-generating material is formed. The presence of the acid may reduce or substantially prevent evaporation of nicotine during drying of the slurry, thereby reducing loss of nicotine during manufacturing.

In certain embodiments, the amorphous solid comprises a gelling agent comprising a cellulosic gelling agent and/or a non-cellulosic gelling agent, an active substance and an acid.

The amorphous solid material may comprise a colorant. The addition of a colorant may alter the visual appearance of the amorphous solid. The presence of colorant in the amorphous solid may enhance the visual appearance of the amorphous solid and the aerosol-generating material. By adding a colorant to the amorphous solid, the amorphous solid may be color-matched to other components of the aerosol-generating material or to other components of an article comprising the amorphous solid.

A variety of colorants may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material comprising the amorphous solid. In some embodiments, the addition of a colorant to the amorphous solid renders it visually indistinguishable from other components in the aerosol-generating material.

The colorant may be incorporated during the formation of the amorphous solid (e.g., when forming a slurry comprising the materials that form the amorphous solid) or it may be applied to the amorphous solid after its formation (e.g. by spraying it onto the amorphous solid).

In some embodiments, the article for use with the non-combustible aerosol provision device may comprise aerosolizable material or an area for receiving aerosolizable material. In some embodiments, the article for use with the non-combustible aerosol provision device may comprise a mouthpiece. The area for receiving aerosolizable material may be a storage area for storing aerosolizable material. For example, the storage area may be a reservoir. In some embodiments, the area for receiving aerosolizable material may be separate from, or combined with, an aerosol generating area.

Thus there has been described an aerosol provision system comprising: a power source; an aerosol generating component; and, control circuitry, wherein the control circuitry is arranged to control the power source and the aerosol generating component to provide a selection between at least: a predetermined aerosolization profile; and a variable aerosolization period, to be applied to aerosol generating material.

The aerosol provision system may be used in a tobacco industry product, for example a non-combustible aerosol provision system.

In one embodiment, the tobacco industry product comprises one or more components of a non-combustible aerosol provision system, such as a heater and an aerosolizable substrate.

In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in or on a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material, and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise an aerosol or aerosol generating agent or a humectant, such as glycerol, propylene glycol, triacetin or diethylene glycol.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, the entirety of this disclosure shows by way of illustration various embodiments in which the disclosure may be practiced and provide for a superior electronic aerosol provision system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An aerosol provision system comprising:

a power source;

an aerosol generating component; and control circuitry, wherein the control circuitry is arranged to control the power source and the aerosol generating component to provide a selection between at least:

a predetermined aerosolization profile, wherein the predetermined aerosolization profile comprises a plurality of aerosolisation phases and a plurality of non-aerosolisation phases; and a variable aerosolization period, wherein the variable aerosolisation period is a period of continuous aerosolisation, wherein the continuous period is variable in length, to be applied to aerosol generating material;

wherein the control circuitry comprises an activatable element for controlling the power source and aerosol generating component, and wherein the control circuitry is configured to determine a state of the activatable element and based on the state of the activatable element, determine whether to select the predetermined aerosolisation profile or the variable aerosolisation period for the aerosol generating material.

2. The aerosol provision system claim 1, wherein the activatable element is at least one of:

a user-activatable element;

a user interface;

a sensor.

3. The aerosol provision system of claim 1, wherein the activatable element is a user-activatable element, and wherein the user-activatable element is a switch that can be affected in a first way to provide a predetermined aerosolization profile to an aerosol generating material and can be affected in a second way to provide a variable aerosolization period to an aerosol generating material.

4. The aerosol provision system of claim 1, wherein the control circuitry is arranged to control the power source and the aerosol generating component to provide a selection between a plurality of predetermined aerosolization profiles and a variable aerosolization period to be applied to an aerosol generating material.

5. The aerosol provision system of claim 4, wherein the plurality of predetermined aerosolization profiles are different predetermined aerosolization profiles, the predetermined aerosolization profiles differing by at least one of:

number of aerosolization phases;

intensity of aerosolization phases; and, frequency of aerosolization phases.

6. The aerosol provision system of claim 1, wherein the predetermined aerosolization profile comprises periods of aerosolization and periods of non aerosolization.

7. The aerosol provision system of claim 1, wherein the aerosol generating component is a heater;

the predetermined aerosolization profile is a predetermined heating profile; and, the variable aerosolization period is a heating period.

8. The aerosol provision system of claim 7, wherein the heater is an inductive heater.

9. A method of producing an aerosol from an aerosol provision system, the method comprising:

providing a power source;

providing an aerosol generating component; and, providing control circuitry, the control circuitry arranged to control the power source and the aerosol generating component, providing a selection between at least:

a predetermined aerosolization profile, wherein the predetermined aerosolization profile comprises a plurality of aerosolisation phases and a plurality of non-aerosolisation phases; and a variable aerosolization period, wherein the variable aerosolisation period is a period of continuous aerosolisation, wherein the continuous period is variable in length, to be applied to aerosol generating material, and applying the selected one of the predetermined aerosolization profile and the variable aerosolization period to aerosol generating material;

wherein the control circuitry comprises an activatable element for controlling the power source and aerosol generating component, and wherein the control circuitry is configured to determine a state of the activatable element and based on the state of the activatable element, determine whether to select the predetermined aerosolisation profile or the variable aerosolisation period for the aerosol generating material.

10. The method of producing an aerosol of claim 9, further comprising activating the activatable element to select between the predetermined aerosolization profile and the variable aerosolization period.

11. The method of producing an aerosol of claim 10, further comprising determining a state of the activatable element and based on the state of the activatable element, determining whether to apply the predetermined aerosolization profile or the variable aerosolization period to the aerosol generating material.

12. The method of producing an aerosol of claim 10, further comprising:

activating the activatable element in a first way or a second way, wherein activating the activatable element in the first way selects the predetermined aerosolization profile, and activating the activatable element in the second way selects the variable aerosolization period.

13. The method of producing an aerosol of claim 9, wherein providing a predetermined aerosolization profile comprises:

providing a predetermined number of aerosolization phases;

providing predetermined intensities of the aerosolization phases; and, providing a predetermined frequency of aerosolization phases.

* * * * *